US008820098B2

(12) United States Patent
Zurecki

(10) Patent No.: US 8,820,098 B2
(45) Date of Patent: Sep. 2, 2014

(54) METHOD AND APPARATUS FOR QUENCHING OF MATERIALS IN VACUUM FURNACE

(75) Inventor: Zbigniew Zurecki, Macungie, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 169 days.

(21) Appl. No.: 13/466,404

(22) Filed: May 8, 2012

(65) Prior Publication Data

US 2013/0118186 A1 May 16, 2013

Related U.S. Application Data

(60) Provisional application No. 61/486,812, filed on May 17, 2011.

(51) Int. Cl.
*F25D 25/00* (2006.01)

(52) U.S. Cl.
USPC ..... 62/62

(58) Field of Classification Search
CPC ..... F25D 25/00; F25D 17/067; F24F 1/0007; F25B 39/02
USPC ..... 62/62, 426, 515, 50.2, 50.4, 51.1, 52.1
See application file for complete search history.

(56) References Cited

U.S. PATENT DOCUMENTS

| | | | | |
|---|---|---|---|---|
| 3,699,696 | A * | 10/1972 | Rhoton | 62/45.1 |
| 4,127,008 | A * | 11/1978 | Tyree, Jr. | 62/62 |
| 4,344,291 | A * | 8/1982 | Tyree et al. | 62/62 |
| 5,398,515 | A * | 3/1995 | Lak | 62/47.1 |
| 5,630,322 | A | 5/1997 | Heilmann et al. | |
| 6,073,864 | A * | 6/2000 | Berghoff et al. | 239/573 |
| 6,783,568 | B1 | 8/2004 | Bowskill et al. | |
| 7,131,277 | B2 * | 11/2006 | Hall et al. | 62/45.1 |
| 7,891,197 | B2 * | 2/2011 | Winter | 62/50.1 |
| 2005/0193743 | A1 * | 9/2005 | Foss et al. | 62/50.2 |
| 2005/0261753 | A1 | 11/2005 | Littrup et al. | |
| 2006/0037678 | A1 | 2/2006 | Leger | |
| 2007/0068606 | A1 | 3/2007 | Oezdeslik et al. | |
| 2008/0271455 | A1 * | 11/2008 | Karpf | 60/671 |
| 2010/0162732 | A1 * | 7/2010 | Newman | 62/52.1 |

FOREIGN PATENT DOCUMENTS

| | | | |
|---|---|---|---|
| CN | 1329175 | A | 1/2002 |
| CN | 1936030 | A | 3/2007 |
| CN | 101972167 | B | 2/2011 |
| EP | 0 955 384 | B1 | 4/2005 |
| GB | 1452062 | A | 10/1976 |
| WO | 0236835 | A1 | 5/2002 |
| WO | 2006105899 | A1 | 10/2006 |
| WO | 2008155426 | A1 | 12/2008 |

OTHER PUBLICATIONS

SCHEMTZ GmbH Vacuum Furnaces; Product Literature; www.schmetz.de.

* cited by examiner

*Primary Examiner* — Mohammad M Ali
(74) *Attorney, Agent, or Firm* — Amy Carr-Trexler

(57) ABSTRACT

A method of quenching a material by injecting a cryogenic fluid into a cooling stream and simultaneously venting gas from the cooling stream, in order to maintain a desired target pressure in a chamber containing the material. In a examplary application of the method, the quenching is a step in the heat-treatment of a metal and the chamber is part of a vacuum furnace. Also disclosed is a method of supplying a cryogenic fluid to a process in which the amount of cryogenic fluid necessary to perform the process is transferred from a storage vessel to a supply vessel via a supply line, after which the supply line is closed. An elevated pressure is maintained by vaporization of a relatively small amount of the cryogenic fluid that is allowed to build in a pressure vessel that is in fluid communication with the supply vessel.

13 Claims, 10 Drawing Sheets

METHOD AND APPARATUS FOR QUENCHING OF MATERIALS IN VACUUM FURNACE

CROSS-REFERENCE TO RELATED APPLICATIONS

This application claims the benefit of U.S. Provisional Application No. 61/486,812, filed on May 17, 2011. The disclosure of Application No. 61/486,812 is hereby incorporated by reference.

BACKGROUND OF THE INVENTION

This invention concerns the field of heat-treating of materials, which involves rapid cooling (also called quenching) at the end of a high-temperature cycle. Rapid cooling is employed when the material being treated exhibits desired phase transformations during rapid cooling from high temperatures. The most common goal of heat treatment in current commercial applications is improved hardness.

Many heat treatment processes are carried out in vacuum furnaces. During the quenching step of a heat treatment cycle, it is often desirable to provide an atmosphere comprising gases that are inert with respect to the material being treated. (The material being treated is also referred to herein as the "heat load" or "HL"). Helium (He) and argon (Ar), or blends thereof, are commonly-used inert gases for this application. Mildly-reactive gases, or blends of inert gases and mildly-reactive gases, are technologically-acceptable and provide a less costly alternative. Nitrogen ($N_2$) and hydrogen ($H_2$) are examples of mildly-reactive gases used in this application, which can be mixed together or provided with secondary gas additions such as carbon dioxide ($CO_2$) or argon.

One common method for conducting a quenching step is the introduction of a cooling gas, which is then circulated inside the vacuum furnace and a water-cooled heat exchanger. Use of highly conductive gases, such as hydrogen and helium, and/or high molecular weight gases, such as argon and carbon dioxide, as the cooling gas can result in desirable cooling rates, but such gases are impractical for many applications. For example, use of helium is often cost-prohibitive. The cost of a helium recovery and recycling system can exceed the cost of a simple, single-chamber vacuum furnace. Use of hydrogen introduces operational risks (due to its flammability) and requires highly trained, reliable operators and dedicated supply and furnace systems. In addition, achieving desired cooling rates with gases introduced at ambient temperature requires the quenching step to be carried out at a relatively high pressure, e.g. 15-35 bars, and the cooling gas to be circulated at a relatively high velocity. This pressure range requires a robust furnace structure that is significantly more expensive than similar structures that offer cooling pressures between 6-12 bars. High-velocity cooling gas flow may result in an undesired, directional, and non-uniform cooling of a heat load that leads to unacceptable dimensional distortion of treated metal parts.

Another approach to increasing cooling rates involves the use of cryogenic fluid in liquefied or cryogenic vapor form. As compared to a cooling gas introduced at non-cryogenic temperatures, a cryogenic fluid will enable increased heat flux from a heat load by virtue of an enlarged temperature difference between the load and the cooling medium. Cryogenic fluids have been substituted for water in heat exchangers used to cool the cooling medium in a quenching step. Liquefied cryogenic gases such as liquid nitrogen (LIN) have been used as the cooling medium. This approach benefits from the enthalpy of liquid boiling as it is injected into the vacuum furnace. Unfortunately, the heat capacity of the cryogenic fluid and the latent heat of LIN that can be injected into a vacuum furnace of a specific volume are insignificant when compared to the heat accumulated in a metal load that must be rapidly removed. Increasing the mass of cryogen injected into a furnace and, thus, increasing the cooling effect, is possible by increasing the quenching pressure. As noted above, however, this approach requires the use of furnaces that can operate at a higher pressure, which is significantly more expensive. Another limitation on existing methods of injecting cryogenic fluids is the inability to rapidly inject cryogenic fluids that tend to rapidly boil and choke injection points or nozzles located inside the hot furnace because they are commonly delivered in a saturated vapor condition.

Accordingly, there is a need for an improved quenching method that provides the heat capacity necessary to quench the material being treated at a lower cost than existing methods.

BRIEF SUMMARY OF THE INVENTION

In one respect, the invention comprises a method of quenching a material, the method comprising: injecting a cryogenic fluid into a first stream of a cooling system that is adapted to circulate the cryogenic fluid through a heat exchanger and a chamber containing the material, the first stream being located upstream from the chamber and downstream from the heat exchanger, the amount of cryogenic fluid injected into the first stream being sufficient to cause the chamber to exceed a target pressure if no cryogenic fluid is vented from the cooling system; circulating the cryogenic fluid through the heat exchanger and the chamber containing the material; and venting a sufficient amount of the cryogenic fluid from a second stream of the cooling system in order to maintain a pressure in the chamber that is no greater than a target pressure.

In another respect, the invention comprises a method of supplying a cryogenic fluid to a process, comprising: transferring the cryogenic fluid from a storage vessel to a supply vessel through a first supply line; isolating the supply vessel from the storage vessel; transferring the cryogenic fluid from the storage vessel to the pressure vessel; isolating the pressure vessel from the storage vessel; allowing the pressure in the storage vessel to increase to a first pressure, the first pressure being greater that the pressure at which the cryogenic fluid is to be supplied to the process; opening a second supply line between the pressure vessel and the supply vessel, resulting in an increase in the pressure in the supply vessel; and supplying the cryogenic fluid from the supply vessel to the process.

BRIEF DESCRIPTION OF SEVERAL VIEWS OF THE DRAWINGS

The foregoing summary, as well as the following detailed description of the invention, will be better understood when read in conjunction with the appended drawings. For the purpose of illustrating the invention, there is shown in the drawings a certain embodiment of the present invention. It should be understood, however, that the invention is not limited to the precise arrangements and instrumentalities shown. In the drawings.

DETAILED DESCRIPTION OF THE INVENTION

Figure 1:
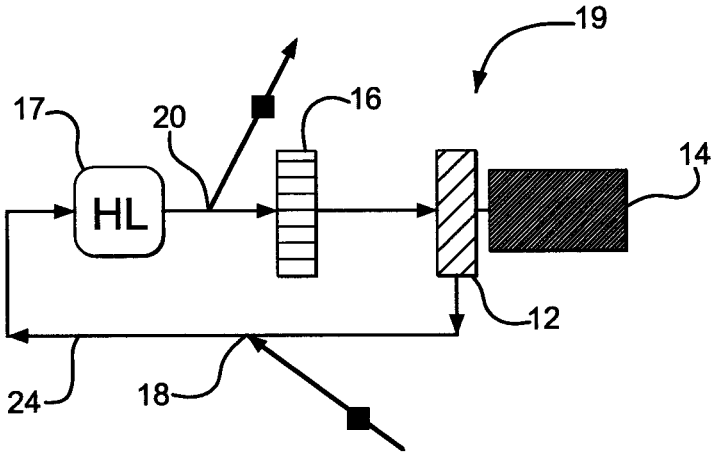
FIG. 1 is a schematic drawing of a vacuum furnace according to a first exemplary embodiment of the present invention.

In describing the embodiments of the invention illustrated in the drawings, specific terminology will be used for the sake of clarity. However, the invention is not intended to be limited to the specific terms so selected, it being understood that each specific term includes all technical equivalents operating in a similar manner to accomplish a similar purpose. It is understood that the drawings are not drawn exactly to scale. The following describes particular embodiments of the present invention. It should be understood, however, that the invention is not limited to the embodiments detailed herein.

For the purposes of the specification and claims, "subcooled LIN" means liquid nitrogen (LIN) at a temperature that is lower than the equilibrium temperature T from the following equation, where P is equal to the LIN pressure in bars and temperature T is expressed in degrees Celsius:

$$T=13\times In(P)-200 \qquad \text{Equation 1}$$

FIG. 1 is a diagram showing a schematic representation of an exemplary cooling system 19 for use in cooling a heat load 17. As is conventional, the cooling system 19 includes a blower 12, which is powered by an electric motor 14, and a heat exchanger 16. During a quenching step, the blower 12 is activated and a cryogenic fluid (such as LIN) is injected into a cooling medium stream 24 at an injection point 18. The cryogenic fluid immediately vaporizes and is circulated past the heat load 17, then a part of the warmed cryogenic vapor moves through the heat exchanger 16 and through the blower 12, where it is recycled. In this example, the heat exchanger 16 uses water as its cooling medium, but any suitable medium for the heat exchanger 16 could be substituted.

Cryogenic fluid is preferably injected into the cooling medium stream 24 in a manner that maintains a relatively constant pressure ("target pressure") in the vacuum furnace in which the cooling system 19 is located as the heat load 17 cools. The cooling system 19 includes a venting point 20, through which the remaining part of the LIN vapor (which has been warmed by the heat load 17) is released from the cooling stream 24 during the quenching step. The venting point 20 is preferably located downstream from the heat load 17 and upstream from the heat exchanger 16. In this example, a significant part of the warmed LIN vapor is released through the venting point 20 at the same time as an incremental "dose" of LIN is being injected into the cooling stream 24. This enables more LIN to be injected into the cooling stream 24 during the quenching process, thereby giving the cooling system 19 greater cooling capacity than would be possible without venting.

It is preferable that the amount of LIN injected into the cooling stream 24 be at least 1.5 times, and more preferably at least twice, the amount of LIN necessary to maintain the target pressure. The amount of LIN vapor vented from the cooling system 19 at venting point 20 is preferably sufficient to maintain the target pressure. For example, if three times the amount of LIN needed to maintain the target pressure is injected at injection point 18, an amount of LIN vapor equivalent to two thirds of the LIN being injected is preferably simultaneously vented from venting point 20. Similarly, if twice the amount of LIN needed to maintain the target pressure is injected at injection point 18, an amount of LIN vapor equivalent to one half of the LIN being injected is preferably simultaneously vented from venting point 20. It should be understood that the terms "injection point" and "venting point" are intended to include any suitable type of injection and venting devices, respectively, including devices that may include multiple ports.

FIGS. 2 through 4 and 12 through 13 each represent schematic diagrams of the use of the cooling system 19 of FIG. 1 in different vacuum furnace arrangements.

In each of these examples, elements shared with the cooling system 19 of FIG. 1 are represented by reference numerals increased by factors of 100. For example, the blower 12 of FIG. 1 corresponds to the blower 112 of FIG. 2 and blower 212 of FIG. 3. In the interest of clarity, some features shown in FIGS. 2-4 and FIGS. 12-13 that are shared with FIG. 1 are numbered in the Figures but are not specifically discussed in the specification.

Figure 2:
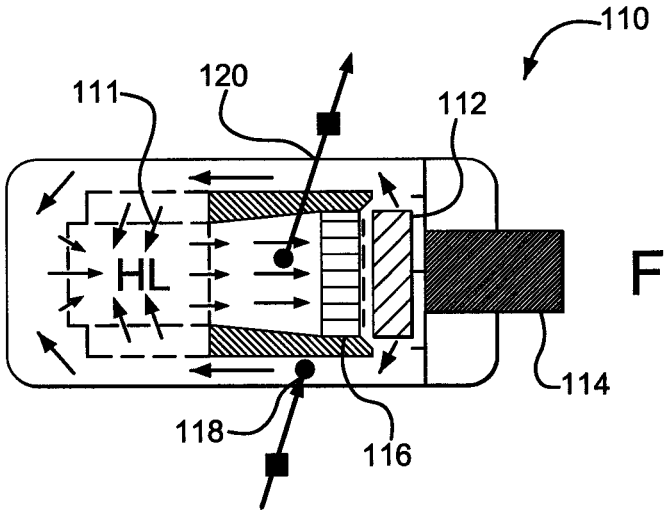
FIG. 2 is a schematic drawing of a vacuum furnace according to a second exemplary embodiment of the present invention.
Figure 3:
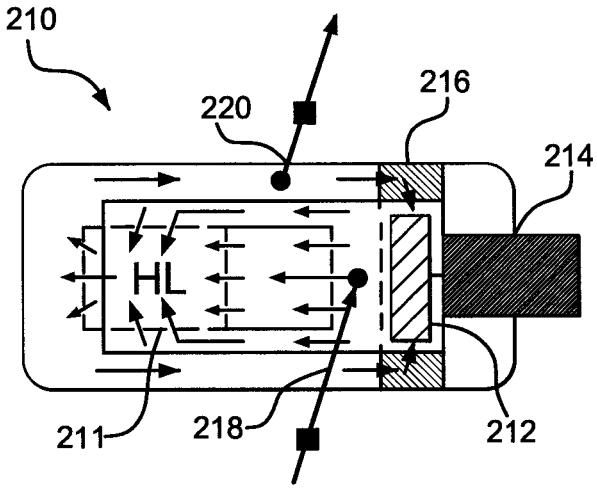
FIG. 3 is a schematic drawing of a vacuum furnace according to a third exemplary embodiment of the present invention.
Figure 4:
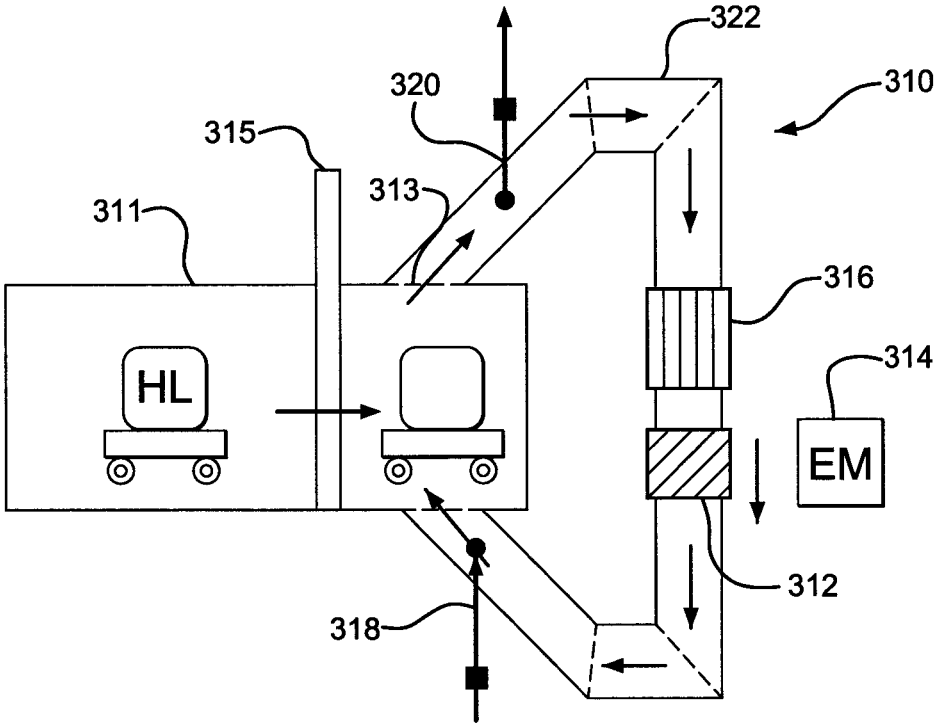
FIG. 4 is a schematic drawing of a vacuum furnace according to a fourth exemplary embodiment of the present invention.

For each of vacuum furnaces 110, 210, and 310, illustrated in FIGS. 2-4, respectively, it is noted that the sequence of HL, gas cooling and gas circulation is always the same: hot gas is drawn via a heat exchanger by a blower or compressor, which then compresses the cooled gas and returns it back toward the heat load, HL, LIN is injected into the portion of the cooling medium stream path that is located between the blower and the heat load (i.e., after the cooling medium has been cooled by the heat exchanger). The excess hot GAN (i.e. warmed LIN vapor) is vented from a portion of the cooling medium stream that is located between the heat load and the heat exchanger.

FIG. 2 illustrates an exemplary embodiment of a vacuum furnace 110 with arrows showing gas circulation patterns of the cooling medium. In this example, the heat exchanger 116 is located directly in front of the blower 112. Gas blower 112 circulates gas radially outward, in a direction generally parallel to the plane of rotation of gas blower 112, along the outer walls of vacuum furnace 110, to vacuum chamber 111.

FIG. 3 shows a vacuum furnace 210 having a heat exchanger 216 that is annular in shape, with blower 212 located within the annulus of heat exchanger 216. Blower 212 circulates gas in a direction generally perpendicular to the plane of rotation of blower 212, into vacuum chamber 211.

FIG. 4 shows a two-chamber vacuum furnace system 310 in which the heat load HL is heated in a hot vacuum chamber 311 (on the left in FIG. 4) and is then transferred into a cold, cooling chamber 313 (on the right in FIG. 4). A door 315 separates the vacuum chamber 311 from the cooling chamber 313 and is closed during the heating process. After heat load HL is heated in the vacuum chamber 311, door 315 opens, heat load HL is transferred to cooling chamber 313, and the door 315 is closed. The quenching process is then carried out in the cooling chamber 313.

Those skilled in the art will recognize that the flow pattern of nitrogen shown in FIG. 4 may differ, and blower 312 as well as heat exchanger 316 could be located outside of the cooling chamber 313, in a cooling loop 322. Configurations in which internal blower 312 and heat exchanger 316 are located in the cooling chamber 313 in a way similar to those shown in FIGS. 2 and 3 are also within the scope of this invention.

Figure 13:
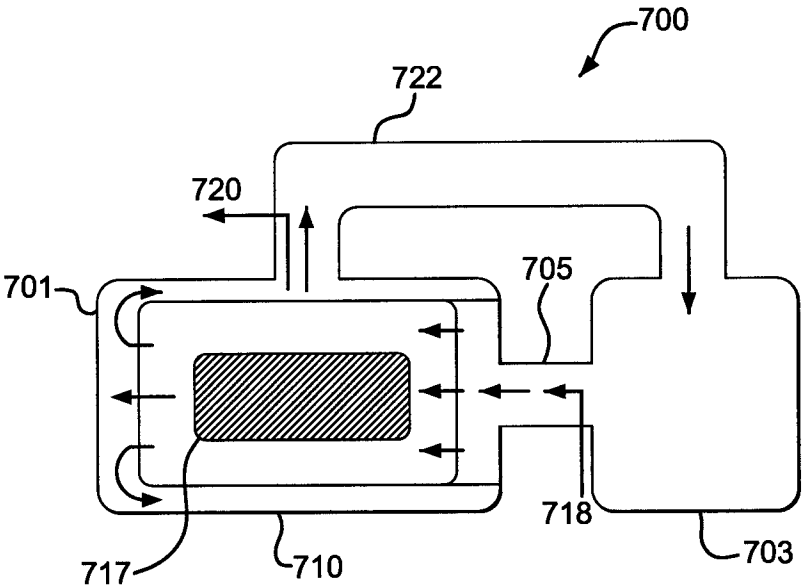
FIG. 13 is a schematic drawing of a vacuum furnace according to a sixth exemplary embodiment of the present invention.
Figure 12:
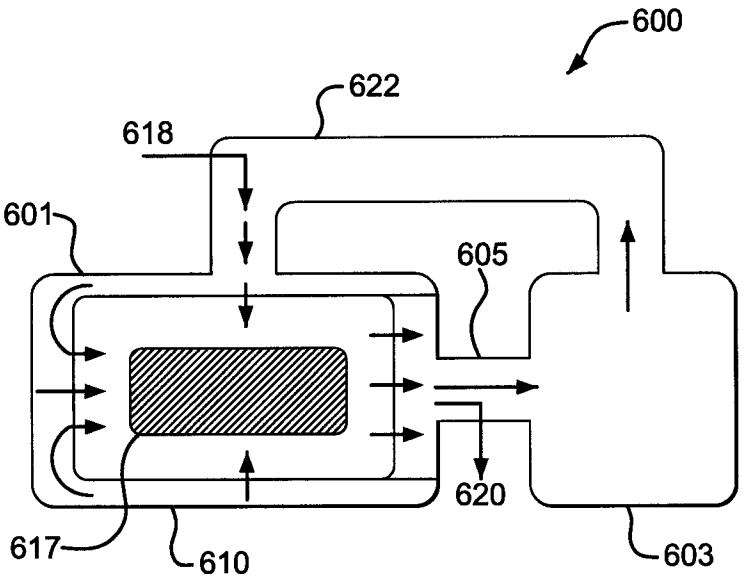
FIG. 12 is a schematic drawing of a vacuum furnace according to a fifth exemplary embodiment of the present invention.

FIGS. 12 and 13 provide additional embodiments 600 and 700, respectively, of the vacuum furnace system 610 and 710 described herein. Both FIGS. 12 and 13 depict two chamber systems wherein the first chamber 601 and 701 houses the heat load 617 and 717 and the second chamber 603 and 703 comprises a water heat exchanger and blower or compressor (not shown) which is in fluid communication with first chamber 601 and 701 via cooling loop 622 and 722. The two chambers are connected to each other with a large pipe 605 and 705 as shown. In both Figures, the liquid nitrogen (LIN) is injected into the system via injection point 618 and 718 and excess nitrogen vapor is withdrawn at vent point 620 and 720. However, in FIG. 12 the flow of cold gas is counter—clockwise whereas in FIG. 13 the flow cold gas is clockwise. In both FIGS. 12 and 13, the first chamber 601 and 701 further comprises an external shell and permeable internal shell that allows hot and cold gas to flow into and out of the first chamber having heat load 617 and 717.

Figure 5:
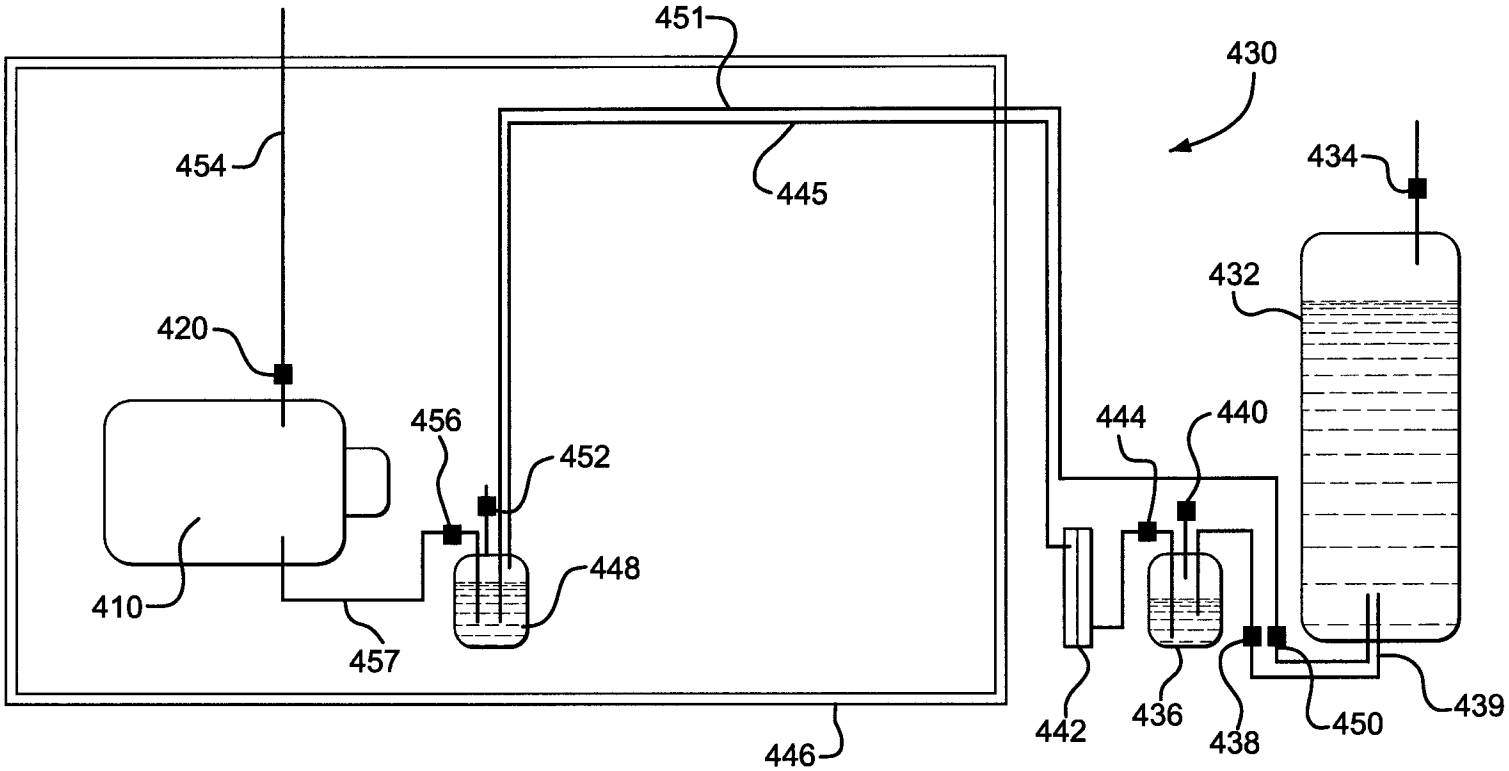
FIG. 5 is a schematic drawing of a LIN supply system for high-pressure quenching in vacuum furnaces according to an exemplary embodiment of the present invention.

FIG. 5 illustrates a supply system 430 for supplying LIN to the quenching process of the present invention. It should be understood that the supply system 430 could be used to supply other cryogenic fluids and could be used to supply a cryogenic fluid for use in other types of processes. The supply system 430 is particularly well-adapted for use in processes in which a supply of cryogenic fluid is required on an intermittent basis.

In this example, the supply system 430 includes a storage container 432, which is preferably maintained at a relatively low pressure P1, e.g., between about 25 PSIG (1.7 bar) and about 125 PSIG (8.5 bar). Pressure in the storage container 432 can be regulated by a pressure relief valve 434. It should be noted that, except for pressure relief valves, the valves used in the supply system 430 can be inexpensive solenoid valves, each of which may be combined with a check-valve that prevents the back flow of LIN or GAN.

In this example, LIN is being supplied to a vacuum furnace 410, which is located inside a building structure 446. For safety and other reasons, the storage container 432 is located outside of the building structure 446. A supply cylinder 448 is positioned within the building structure 446 and near the vacuum furnace 410. A supply line 451 connects the supply cylinder 448 to the storage container 432. The supply cylinder 448 is connected to the vacuum furnace 410 by a supply line 457 having a valve 456 positioned thereon. The supply line 457 is adapted to supply LIN to the LIN injection point (not shown) for the vacuum furnace 410. The supply cylinder 448 also preferably includes a pressure relief valve 452.

The supply system 430 also includes a pressure cylinder 436, which is connected to the storage container 432 by a supply line 439 having a valve 438 located thereon. The pressure cylinder 436 is connected to the supply cylinder 448 by a supply line 445 having a valve 444 located thereon. A vaporizer 442 is preferably positioned in-line between the pressure cylinder 436 and the supply cylinder 448.

Figure 6:
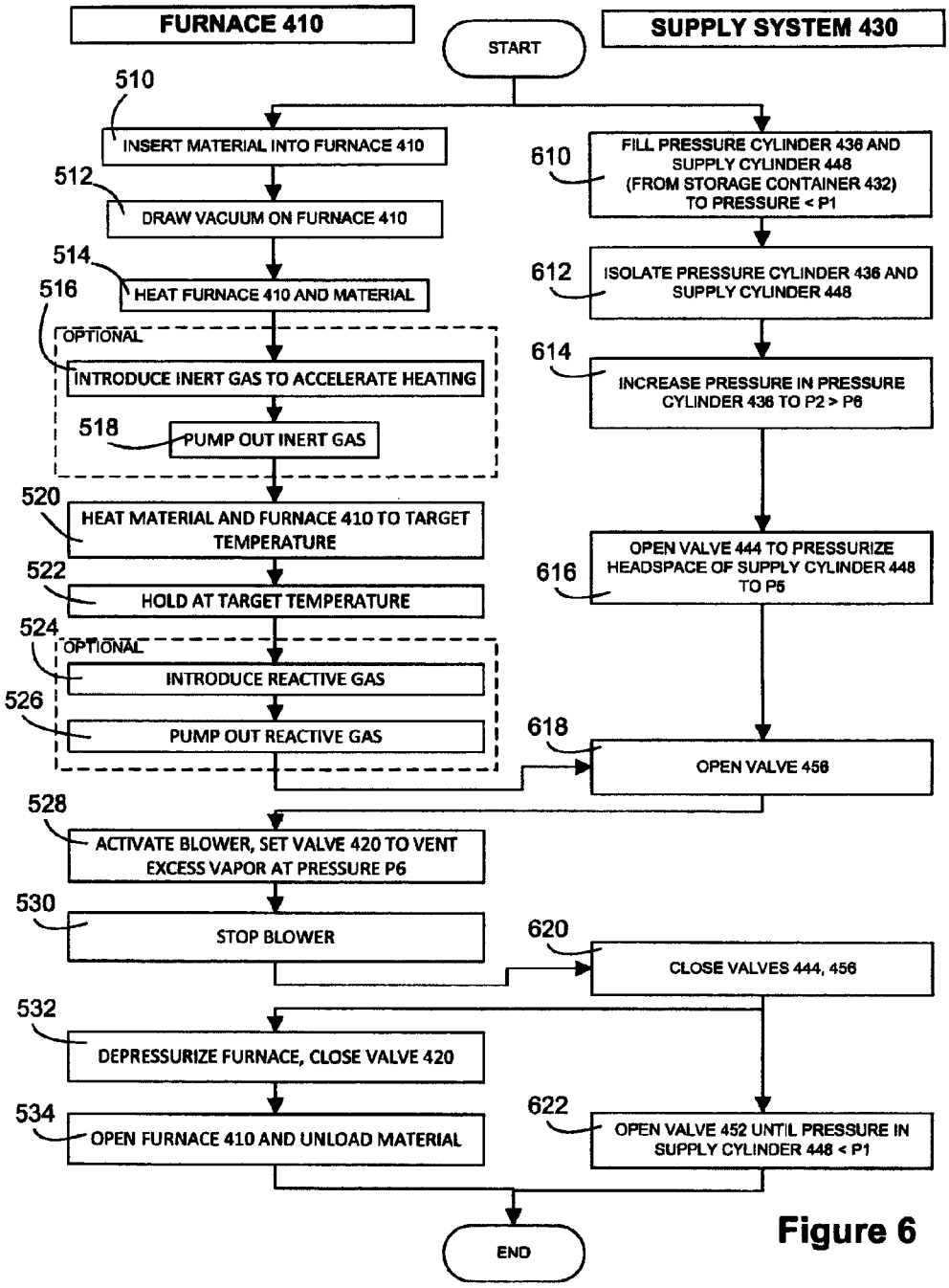
FIG. 6 is a flowchart depicting an example of the operation of the furnace and supply system shown in FIG. 5.

FIG. 6 illustrates an examplary method of operating the vacuum furnace 410 and the supply system 430. At the beginning of the process, the material to be treated (heat load) is inserted into the furnace 410 (step 510), the furnace chamber is closed and a vacuum is drawn on the chamber (step 512). The furnace 410 and the material are then heated (step 514). Optionally, heating can be accelerated via convection by pumping a heated inert gas into the furnace chamber (step 516), then evacuating the inert gas (step 518). These optional steps are typically performed at furnace temperatures below 750 degrees C. Heating of the material continues until the material and furnace 410 reach a target temperature (step 520). The material and furnace 410 are typically held at the target temperature for a period of time (step 522). Optionally, the material could then be subjected to a surface and/or diffusional treatment by introducing a reactive gas (such as a hydrocarbon) into the furnace 410 (step 524), then evacuating the reactive gas (step 526).

Next, the material is quenched. Prior to the commencement of a quenching operation, however, the supply cylinder 448 preferably has sufficient LIN contained therein to provide the total quantity of UN required for a single quenching operation. Preferably, the supply cylinder 448 contains at least 10% more LIN than required for a quenching operation. An example of the process of preparing the supply cylinder 448 for a quenching operation is set forth below.

First, LIN is transferred from the storage container 432 to the supply cylinder 448 and pressure cylinder 436 (step 610). In this example, the supply cylinder 448 is equipped with a LIN level sensor (not shown). When the LIN level in the supply cylinder 448 drops to a first predetermined level (as determined by the sensor), valve 450 is opened and LIN flows from the storage container 432, through the supply line 451, and to the supply cylinder 448. The pressure P5 in the supply cylinder 448 is preferably reduced to a pressure that is lower than the storage container pressure P1 prior to beginning the transfer of LIN from the storage container 432. This can be accomplished by opening and closing the valve 452 just prior to the filling step (step 610). When the sensor detects that the LIN level in the supply cylinder 448 has rised to a second predetermined level, the valve 450 is closed. After filling, the pressure in the supply cylinder 448 will be slightly less than the pressure P1 in the storage container 432, due primarily to friction and gravity losses.

Because the flow of LIN through the supply line 451 is intermittent, no LIN resides in the supply line when the supply cylinder 448 is not being filled. This allows the supply line 451 to be made of metal or polymer tubing with low-cost polymer foam insulation, which substantially reduces the cost of the supply line 451 as compared to prior art systems in which vacuum-jacketed lines would typically be required.

After the filling step (step 610) and prior to the commencement of the next quenching operation, the pressure cylinder 436 and supply cylinder 448 are isolated from the rest of the system 430 (step 612), then the pressure P5 in the supply cylinder 448 is preferably increased to a pressure that is significantly higher than P1 (step 614). In order to accomplish this, a small amount of LIN is drawn into the pressure cylinder 436 by opening the valve 438. Valve 438 is then closed and LIN inside the pressure cylinder 436 is pressurized to a pressure P2 by a conventional pressure build-up coil (not shown). Pressure P2 exceeds (preferably by at least 25%) the desired pressure P6 in the vacuum furnace 410 during the quenching operation. A time delay (typically a few minutes) is preferably provided between the closing of valve 438 and the opening of valve 444 to allow the pressure cylinder 436 to reach the desired pressure P2 (step 614). As necessary, pressure P2 can be relieved in the pressure cylinder 436 by a pressure relief valve 440.

The valve 444 is then opened (step 616), which allows LIN to flow through the vaporizer 442, where it is converted to high-pressure GAN. The GAN then, in a way resembling piston action, pressurizes the headspace of the supply cylinder 448 via the supply line 445. In order to maintain the desired pressure P5 in the supply cylinder 448, the valve 444 is preferably kept open during periods in which LIN is being supplied to the vacuum furnace 410. In a less preferred option, the valve 444 may be kept open at all times except when LIN is being transferred from the storage container 432 to the supply cylinder 448.

Increasing the headspace pressure P5 of the supply cylinder 448 as set forth in the previous paragraph has the effect of "subcooling" the LIN in the supply cylinder 448, which reduces boiling of LIN during discharging into a lower pressure environment and improves the downstream flow characteristics of LIN. Consequently, LIN can be transferred to the vacuum furnace 410 via simple metal or polymer foam tubing, instead of the conventional vacuum jacketed tubing.

Using subcooled LIN in the supply cylinder 448 has other beneficial effects. LIN stored in storage container 432 is saturated (in equilibrium with its vapor) at pressure P1.

When the LIN is transferred to the supply cylinder 448, the LIN continues to be saturated at pressure P1 for a considerable period of time required to "leak" heat into supply cylinder 448 from the surroundings. This period of time is significantly longer than the time-scale of furnace heating and quenching operations due to the cryogenic insulation of supply cylinder 448. Consequently, LIN stored in the supply cylinder 448 stays at the temperature not much higher than the equilibrium temperature corresponding to the pressure P1 throughout the entire vacuum furnace quenching cycle.

In order to reduce LIN boil-off, the supply cylinder 448 is preferably pressurized from less than P1 to P5, which is higher than P6, just prior to the commencement of the quenching step in the vacuum furnace 410.

In order to initiate quenching, valve 456 is opened (step 618) to spray LIN into the vacuum furnace 410. As soon as the furnace pressure approaches the target quenching pressure, P6, the blower is activated and valve 420 is set to vent excess LIN vapor when the actual pressure in the furnace exceeds P6 (step 528). Since the amount of LIN injected is more than the amount needed to reach the desired pressure P6 in the vacuum furnace, valve 420 (set to release at pressure P6) opens to vent out the excess GAN via a venting duct 454. As the quenching progresses, the temperature inside vacuum furnace 410 rapidly drops, resulting in the internal pressure dropping to below pressure P6 which, in turn, results in the injection of additional LIN via supply line 457.

The speed of injection and the uniformity of spraying LIN inside the vacuum furnace 410 have a direct effect on the success of the quenching operation. Subcooled LIN can also be injected into the vacuum furnace 410 at a higher flow rate than saturated LIN and can be spray-atomized inside the vacuum furnace 410 by a nozzle or nozzles (not shown) in a much more uniform and predictable way. For example, the initial dose of LIN that is injected at the beginning of the quenching process is preferably delivered in 10 seconds or less. This is difficult (if not impossible) to achieve using saturated LIN because the nozzles (or other injection devices) will be extremely hot and the saturated LIN will boil instantly upon coming in contact with the nozzles. This is, however, possible to achieve using subcooled LIN, which will not boil as rapidly.

When the final furnace quenching temperature is reached, valves 420, 444, and 456 are closed and the blower is stopped (steps 530, 620, and 532). The vacuum furnace is then depressurized (preferably to ambient pressure) and the heat-treated material is removed (steps 532, 534). The process can then be repeated. Prior to repeating the filling step (step 610), valve 452 is is opened until the pressure in the supply cylinder 448 is reduced to less than P1 (step 622).

EXAMPLE 1

A vacuum furnace having a volume of 5 cubic meters is used to heat treat a material (heat load) having a mass of 500 kg and a specific heat of 0.50 kJ/(kg K). The temperature of the material at the beginning of a quenching operation is 1000 degrees C. and the desired temperature at the end of the quenching operation is 100 degrees C.

The vacuum furnace is configured like the vacuum furnace 110 shown in FIG. 2. It should be noted that the data provided in association with this example represent calculated values. Where applicable, the assumptions upon which these calculations are based are identified.

Figure 7:
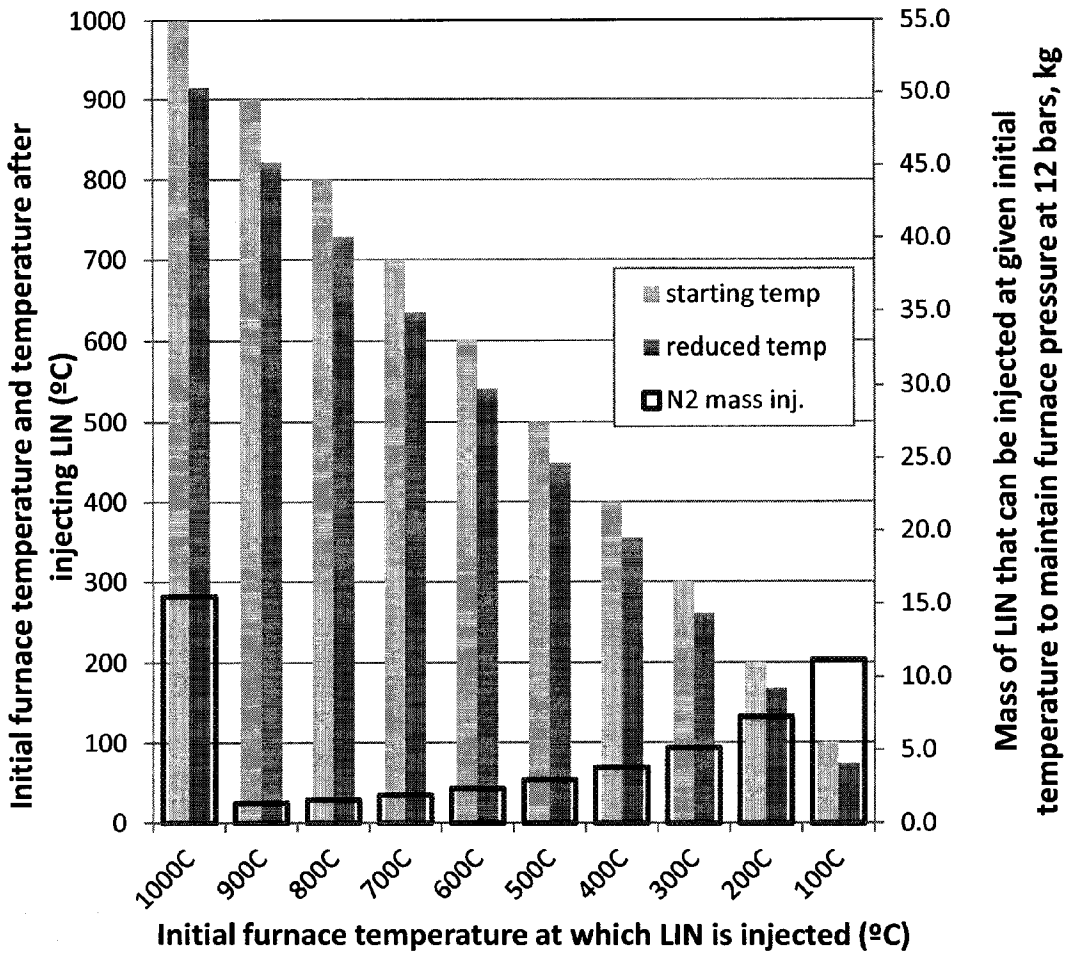
FIG. 7 is a graph illustrating theoretical furnace temperature reduction from initial, specified temperature, as a result of injecting nitrogen into a vacuum furnace according to the prior art.

FIG. 7 is graph showing the amount of nitrogen that would be needed to maintain a pressure of 12 bars (without venting) for each 100 degree temperature drop in the chamber. The initial LIN injection would be about 15.5 kg and a total of about 53.0 kg of nitrogen would be required for the entire quenching process.

The temperature drops shown FIG. 7 due to the injection of LIN were calculated as follows:

$$Tr=\{Tf(Mf\,Cf+Mnp\,Cn)+Mn(Cn\,Tn-H)\}/(Mf\,Cf+Mnp\,Cn+Mn\,Cn) \qquad \text{Equation 2}$$

where:

Mn=mass of LIN injected at a given temperature level to match 12 bar pressure req. [kg]

Mnp=total mass (kg) of previously-injected LIN

Mf=mass (kg) of furnace load (500 kg in this example)

Cn=specific heat capacity of LIN vapor (1.05 kJ/(kg K); assumed constant)

Cf=specific heat capacity of furnace load (0.50 kJ/(kg K), assumed constant)

Tn=initial vapor temperature of injected LIN (77 degrees K)

Tf=initial temperature of furnace and load (degrees K)

Tr=reduced temperature (degrees K) of furnace load and injected LIN vapor

H=LIN boiling enthalpy=200 kJ/kg, assumed to be constant (simplification)

Figure 8:
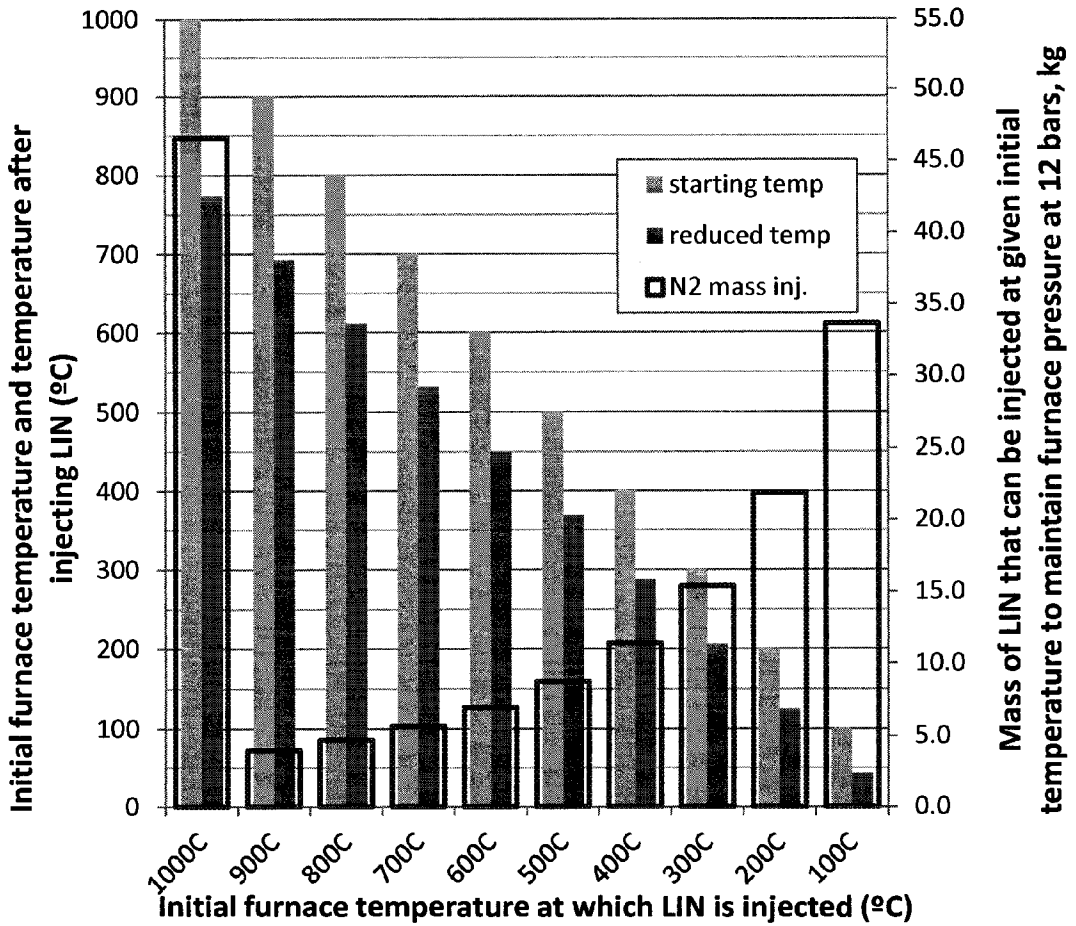
FIG. 8 is a graph illustrating theoretical furnace temperature reduction from initial, specified temperature, as a result of injecting a triple mass of nitrogen into a vacuum furnace according to the present invention.

FIG. 8 is graph showing the amount of nitrogen that would be needed to maintain a pressure of 12 bars (with venting at a rate equal to two-thirds of the injection rate) for each 100 degree temperature drop in the chamber. The initial LIN injection would be about 46.6 kg and a total of about 159.0 kg of nitrogen would be required for the entire quenching process. In this example, LIN is injected at a rate that is three times the rate (on a mass basis) necessary to maintain a pressure of 12 bars in the chamber and nitrogen is vented from the chamber at a rate equal to about two-thirds of the rate of injection (referred to herein as "triple mass LIN injection").

The temperature drops shown in FIG. 8 due to the injection of triple LIN quantity and venting two thirds of the resultant, warmed vapor were calculated as follows, using the same variable values as Equation 2 (above):

$$Tr=\{Tf(Mf\ Cf+Mnp\ Cn)+3Mn(Cn\ Tn-H)\}/(Mf\ Cf+Mnp\ Cn+3Mn\ Cn) \quad \text{Equation 3}$$

Figure 9:
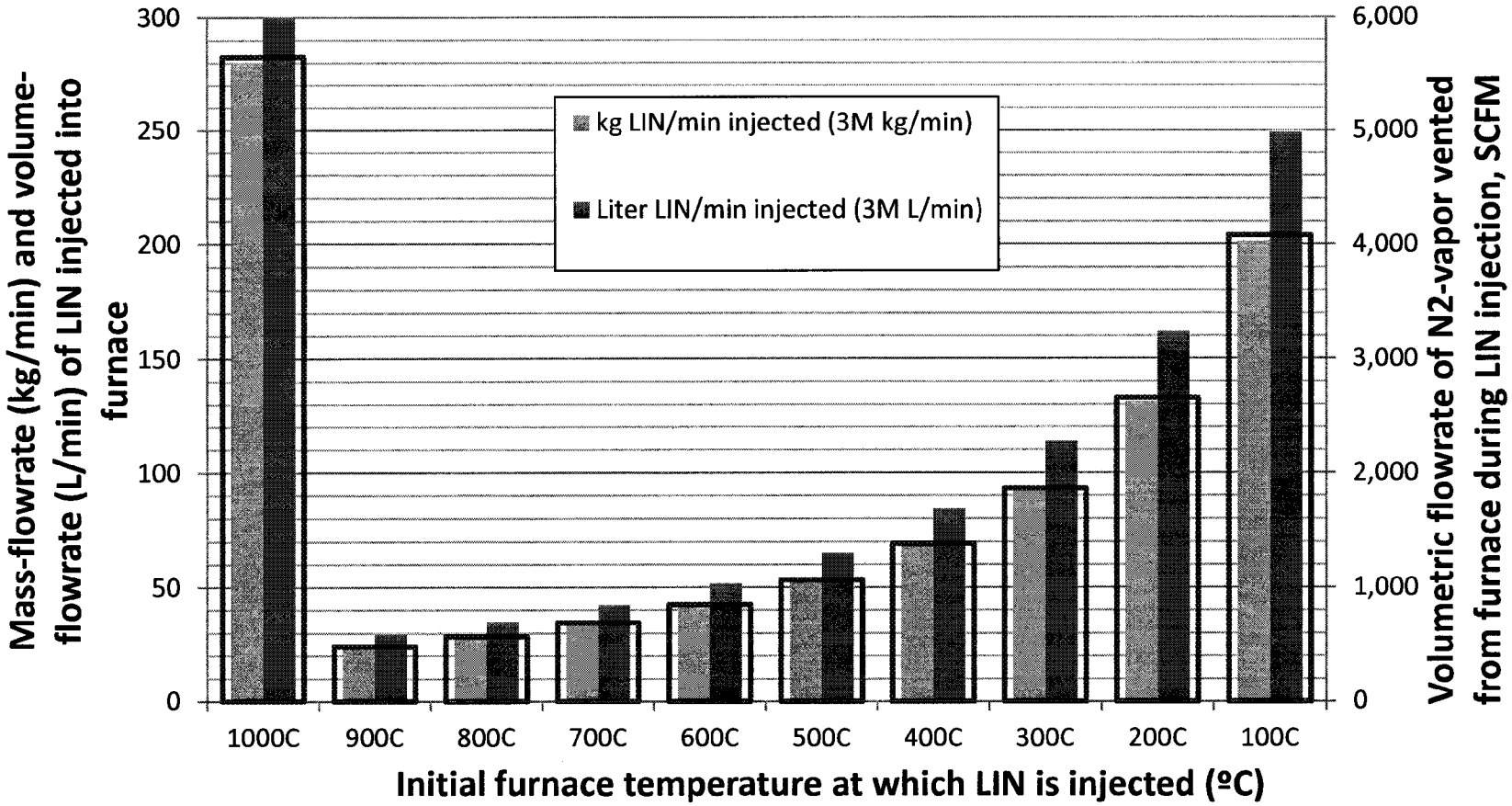
FIG. 9 is a chart illustrating theoretical mass-flowrate and volumetric-flowrate of LIN injected into and volumetric-flowrate of $N_2$ vented from a furnace according to an exemplary embodiment of the present invention.

FIG. 9 is a graph showing approximate mass and volume flow rates for triple mass LIN injection into a furnace chamber and volumetric flow rates for nitrogen vented from the chamber during the quenching process. In FIG. 9, it is assumed the LIN is injected (and nitrogen vented) at ten second intervals each time the temperature in the chamber drops 100 degrees Celsius. The LIN injection flow rates range from the high of 345 liters per minute (the initial injection at 1000 degrees C.) to 29 liters per minute. These are relatively high liquid flowrates that can be best achieved using subcooled LIN injected under pressure head generated in a remote source (such as the supply system 430 shown in FIG. 5). The simultaneous vent-out flowrates of the hot nitrogen gas range from 5,656 Standard Cubic Feet per Minute (SCFM) to 482 SCFM. These are relatively high gas flowrates that require the use of a suitably large vent duct.

Figure 10:
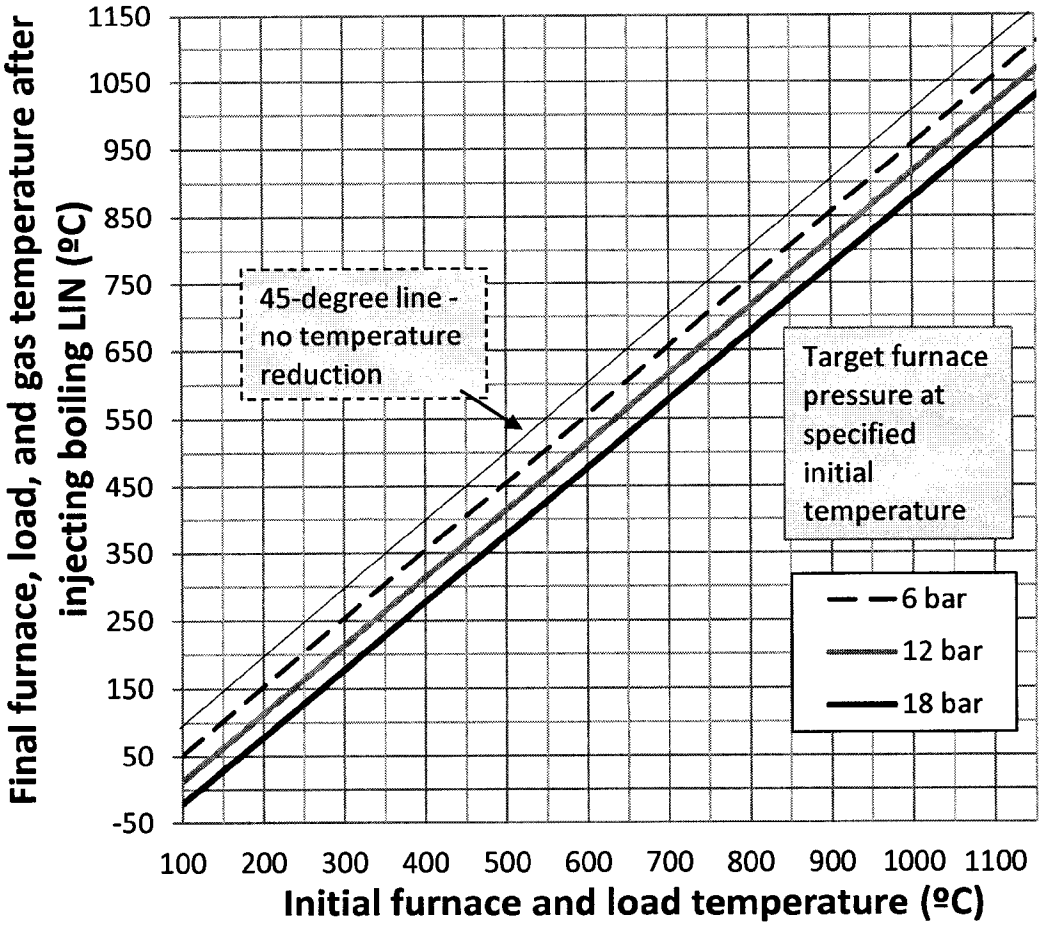
FIG. 10 is a chart illustrating theoretical furnace temperatures for different masses of $N_2$ injected into a vacuum furnace according to the prior art to reach specific pressure at specified, initial temperature.
Figure 11:
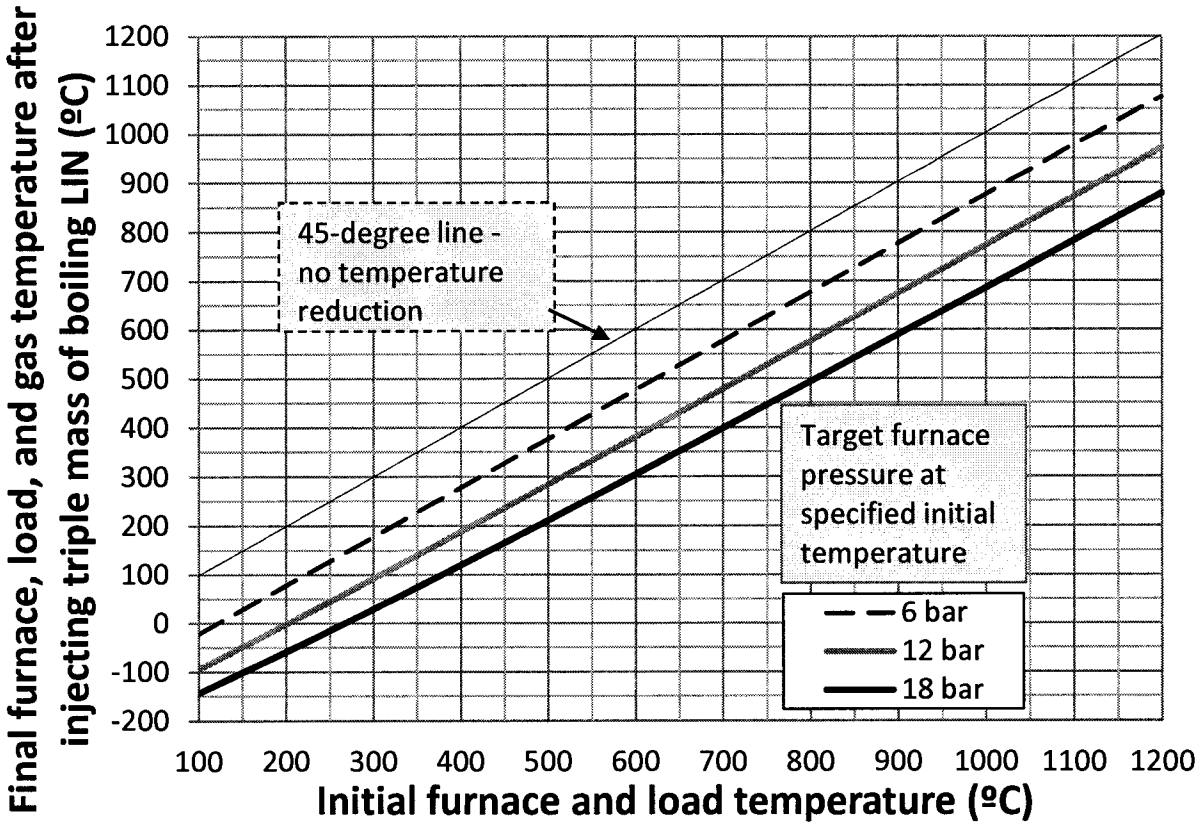
FIG. 11 is a chart illustrating theoretical furnace temperatures for different masses of $N_2$ injected into a vacuum furnace according to the present invention to reach specific pressure at specified, initial temperature.

FIG. 10 is a graph in which the temperature of the chamber and material just prior to each ten-second injection and venting of nitrogen interval (x-axis) is plotted against the temperature immediately after each ten-second injection and venting of nitrogen interval (y-axis) for LIN injection without venting. FIG. 11 shows the same information for triple mass LIN injection combined with venting. The lines "6 bar", "12 bar", and "18 bar" refer to the target quenching pressure inside furnace. As already illustrated by FIGS. 7 and 8, the temperature drop is larger using the vapor-venting quenching method.

Also worthy of note is the fact that injection of LIN at temperatures below 100 degrees C. could result in subzero temperatures inside the furnace, which is desirable when completing martensitic transformation of certain alloy steels.

As reflected in FIGS. 7-8 and 10-11, triple mass LIN injection results in a significantly greater cooling rate for the heat load than with LIN injection with no venting. The increase in cooling performace can be quantified by several data points in the figures. For example, in FIG. 8, for the target pressure of 12 bars and the furnace temperature at the initial injection of 1000 degrees C., the instant equilibrium temperature after the first LIN injection is 773 degrees C. with triple mass LIN injection, as compared to 915 degrees C. using conventional LIN injection with no venting (see FIG. 7). Also, the subzero treatments of steels may be started for injections at and below 200 degrees C.

In summary, the calculations detailed in FIGS. 7-11 show that the present inventive method, involving the injection and boiling of 'excessive' quantities of LIN in a vacuum furnace, combined with the simultaneous venting of the 'excess' gas, can remove significant quantities of heat and, thus, significantly accelerate metal cooling rates. It should be noted that the injection and simultaneous venting of 'excess' LIN could be particularly important in applications involving martensitic transformation hardening of medium and low-alloy steels.

As such, an invention has been disclosed in terms of preferred embodiments and alternate embodiments thereof. Of course, various changes, modifications, and alterations from the teachings of the present invention may be contemplated by those skilled in the art without departing from the intended spirit and scope thereof.

The invention claimed is:

1. A method of quenching a material, the method comprising:

injecting a cryogenic fluid into a first stream of a cooling system that is adapted to circulate the cryogenic fluid through a heat exchanger and a chamber containing the material, the first stream being located upstream from the chamber and downstream from the heat exchanger, the amount of cryogenic fluid injected into the first stream being sufficient to cause the chamber to exceed a target pressure if no cryogenic fluid is vented from the cooling system;

circulating the cryogenic fluid through the heat exchanger and the chamber containing the material; and venting a sufficient amount of the cryogenic fluid from a second stream of the cooling system in order to maintain a pressure in the chamber that is no greater than a target pressure.

2. The method of claim 1, wherein the injecting step further comprises injecting at least 1.5 times the amount of cryogenic fluid into the first stream necessary to cause the chamber to exceed a target pressure if no cryogenic fluid is vented from the cooling system.

3. The method of claim 1, wherein the injecting step further comprises injecting at least three times the amount of cryogenic fluid into the first stream necessary to cause the chamber to exceed a target pressure if no cryogenic fluid is vented from the cooling system.

4. The method of claim 1, wherein the injecting step is initiated prior to initiating the circulating step.

5. The method of claim 1, wherein the venting step comprises releasing cryogenic fluid through a pressure relief valve that is set to release at the target pressure.

6. The method of claim 1, wherein the injecting step comprises injecting a cryogenic fluid comprising subcooled cryogenic liquid.

7. The method of claim 1, wherein the injecting step comprises injecting a cryogenic fluid into a first stream of a cooling system that is adapted to circulate the cryogenic fluid through a heat exchanger and a chamber containing the material.

8. A method of supplying a cryogenic fluid to a process, comprising:

transferring the cryogenic fluid from a storage vessel to a supply vessel through a first supply line;

isolating the supply vessel from the storage vessel;

transferring the cryogenic fluid from the storage vessel to the pressure vessel;

isolating the pressure vessel from the storage vessel;

allowing the pressure in the pressure vessel to increase to a first pressure, the first pressure being greater that the pressure at which the process is performed;

opening a second supply line between the pressure vessel and the supply vessel, resulting in an increase in the pressure in the supply vessel; and supplying the cryogenic fluid from the supply vessel to the process.

9. The method of claim 8, wherein transferring the cryogenic fluid from a storage vessel to a supply vessel through a first supply line, further comprises transferring sufficient cryogenic fluid to perform the process.

10. The method of claim 8, further comprising keeping the second supply line open during the entire supplying step.

11. The method of claim 8, wherein the opening step results in subcooling of a liquid portion of the cryogenic fluid in the supply vessel.

12. The method of claim 8, wherein the supplying step comprises supplying the cryogenic fluid from the supply vessel to the process, the process comprising the quenching of a metal.

13. The method of claim 8, wherein the supplying step comprises supplying the cryogenic fluid from the supply vessel to the process, the process comprising the quenching of a metal in a vacuum furnace.

* * * * *